US010676268B2

(12) United States Patent
Ekkert

(10) Patent No.: US 10,676,268 B2
(45) Date of Patent: Jun. 9, 2020

(54) DISPENSING CLOSURE SYSTEM WITH SLITTED LINER

(71) Applicant: PHOENIX CLOSURES, INC., Naperville, IL (US)

(72) Inventor: Len Ekkert, Lemont, IL (US)

(73) Assignee: PHOENIX CLOSURES, INC., Naperville, IL (US)

( * ) Notice: Subject to any disclaimer, the term of this patent is extended or adjusted under 35 U.S.C. 154(b) by 0 days.

(21) Appl. No.: 16/142,253

(22) Filed: Sep. 26, 2018

(65) Prior Publication Data

US 2020/0095050 A1 Mar. 26, 2020

(51) Int. Cl.
*B65D 83/00* (2006.01)

(52) U.S. Cl.
CPC ..... *B65D 83/0094* (2013.01)

(58) Field of Classification Search
CPC ..... B05B 11/047; B65D 47/2031; B65D 83/0094
USPC ..... 222/206, 212, 213
See application file for complete search history.

(56) References Cited

U.S. PATENT DOCUMENTS 3,360,169 A * 12/1967 Susuki ..... B65D 47/06 222/482
3,556,122 A * 1/1971 Laerdal ..... A61M 16/208 137/102
3,702,100 A 11/1972 Wharton
3,821,871 A 7/1974 Schmitt
4,098,434 A * 7/1978 Uhlig ..... B65D 83/0055 222/105
4,147,278 A * 4/1979 Uhlig ..... B65D 83/0055 222/400.8
4,842,165 A * 6/1989 Van Coney ..... B65D 83/0055 222/95
5,012,956 A * 5/1991 Stoody ..... B65D 83/0055 222/206
5,154,325 A * 10/1992 Ryder ..... B05B 11/047 222/189.06
5,250,266 A * 10/1993 Kanner ..... A45C 11/005 134/901
5,305,920 A * 4/1994 Reiboldt ..... B65D 83/0055 222/105
5,312,018 A * 5/1994 Evezich ..... B65D 83/0055 222/105
5,318,204 A * 6/1994 Davis ..... B65D 83/0055 222/105

(Continued)

FOREIGN PATENT DOCUMENTS

DE 2530588 1/1976

*Primary Examiner* — Paul R Durand
*Assistant Examiner* — Randall A Gruby
(74) *Attorney, Agent, or Firm* — Husch Blackwell LLP

(57) ABSTRACT

The present invention relates to provides a dispensing closure assembly for connection to a container, the assembly including a closure member attachment to a container and a flow control member for controlling the flow of material from the container in response to increased pressure inside the container, where the flow control member having one or more slits, so that upon an increase of pressure inside the container, the flow control member deforms to create at least one opening adjacent to the slits thereby allowing a flowable material to be dispensed from the container. The invention further relates to a flow control member that can return to its undeformed configuration to provide a resealing system.

6 Claims, 13 Drawing Sheets

(56) References Cited

U.S. PATENT DOCUMENTS 5,353,968 A * 10/1994 Good, Jr. ..... B65D 47/10 222/212
5,454,486 A * 10/1995 MacK ..... B05B 11/047 222/105
5,667,089 A * 9/1997 Moore ..... B65D 41/045 215/351
5,938,087 A * 8/1999 Randall ..... B65D 47/0838 222/547
6,044,994 A * 4/2000 Miller ..... B65D 41/045 215/341
6,095,382 A * 8/2000 Gross ..... B65D 47/242 215/271
6,186,374 B1 * 2/2001 Gross ..... B65D 47/0838 222/494
6,250,507 B1 6/2001 Ekkert
6,293,437 B1 * 9/2001 Socier ..... B65D 47/2031 222/212
6,325,227 B1 * 12/2001 Ekkert ..... B65D 41/3447 215/252
D456,700 S 5/2002 Miller et al.
6,530,504 B2 * 3/2003 Socier ..... B65D 47/2031 222/212
6,672,487 B1 * 1/2004 Lohrman ..... B65D 47/0804 222/1
6,726,063 B2 * 4/2004 Stull ..... B65D 47/2031 222/212
6,802,428 B2 * 10/2004 Ekkert ..... B65D 51/1622 215/307
6,918,713 B2 7/2005 Kramski
7,128,245 B2 * 10/2006 Lee ..... B65D 47/0809 222/212
7,494,297 B2 2/2009 Brede et al.
7,681,750 B2 * 3/2010 Jackel ..... B65D 47/06 215/235
8,016,162 B2 * 9/2011 Cleary ..... B65D 1/0223 215/216
8,181,329 B2 5/2012 Buhri et al.
8,397,956 B2 * 3/2013 Olechowski ..... B65D 47/2031 222/494
8,485,398 B2 * 7/2013 Kneer ..... B65D 47/18 222/494
8,640,928 B2 * 2/2014 Ellenkamp-Van Olst ..... B65D 47/0809 137/843
9,580,214 B2 * 2/2017 Hatton ..... B65D 47/2031
9,833,799 B2 * 12/2017 Minnette ..... B05B 11/047
9,845,180 B2 * 12/2017 Rap ..... B65D 43/16
10,287,066 B2 * 5/2019 Hatton ..... F16K 15/147
2004/0251278 A1 * 12/2004 Arai ..... B65D 47/2031 222/212
2006/0138163 A1 * 6/2006 Danks ..... B65D 47/2031 222/1
2008/0264979 A1 * 10/2008 Nijland ..... B65D 47/2031 222/494
2009/0095775 A1 * 4/2009 Domoy ..... A45D 34/00 222/212
2009/0302073 A1 * 12/2009 McKeown ..... A47K 5/122 222/571
2010/0314418 A1 * 12/2010 Roth ..... B65D 41/26 222/205
2012/0114800 A1 * 5/2012 McKay ..... A23L 2/52 426/72
2014/0209644 A1 * 7/2014 Socier ..... B65D 47/2031 222/494
2015/0069007 A1 * 3/2015 Ekkert ..... B65D 41/3428 215/252
2015/0217911 A1 * 8/2015 Wilson ..... A61J 9/005 222/213
2016/0251125 A1 * 9/2016 Drennow ..... B65D 47/2031 222/1
2018/0244440 A1 * 8/2018 Beilke ..... B65D 47/0804
2018/0265238 A1 * 9/2018 Wilson ..... A61J 9/005
2019/0161253 A1 * 5/2019 Hoefte ..... B65D 47/2031
2019/0218001 A1 * 7/2019 Vredevoogd ..... B65D 47/065

* cited by examiner

DISPENSING CLOSURE SYSTEM WITH SLITTED LINER

BACKGROUND OF THE INVENTION

Dispensing closure assemblies having a closure and a liner are known in the art. One type of dispensing closure assembly includes a threaded closure and a perforated liner that fit onto a container, for dispensing the contents of the container when positive pressure is applied to the container. Such an arrangement can be used, for example, for storing and dispensing flowable materials, such as liquids, fine particles, and solid spheres.

The volume and flow rate of flowable material can be limited by the size or configuration of the opening created by the liner. There is a need for a dispensing closure assembly configured for dispensing the flowable materials readily and efficiently when desired. In particular, there is a need for a dispensing closure assembly configured so that the closure guides the liner to adopt a configuration having an opening of a sufficient size and configured to enable the dispensing of the flowable material from the container at an acceptable rate and volume.

BRIEF SUMMARY OF THE INVENTION

The present invention relates to a dispensing closure assembly for connection to a container, including a flow control means for controlling the flow of material from the container in response to increased pressure inside the container, where the flow control means can include a member having one or more slits, so that upon an increase of pressure inside the container, the deformable member deforms to create at least one opening adjacent to the slits thereby allowing the material to be dispensed from the container. The invention particularly relates to a dispensing closure assembly or system configured to readily adopt a dispensing configuration when activated by the user. The present invention also relates to controlling the rate and volume of material flowing from the container in response to pressure applied to the contents of a container.

The present invention embodies a number of aspects that can be implemented separately from or in combination with each other.

One aspect of the invention relates to a closure system for an associated container that dispenses flowable product through a container opening by an application of manual pressure, comprising: 1) a closure comprising: i) an dispensing portion comprising a mouth, ii) an annular wall disposed radially around the dispensing portion, the annular wall sloping horizontally and vertically away from the dispensing portion, and iii) a skirt disposed radially around the annular wall; and 2) a resiliently deformable liner having one or more slits defining a plurality of flaps, the resiliently deformable liner positioned between the closure and the container; where upon the application of manual pressure to the container, the resiliently deformable liner deforms from an undeformed position to an actuated position, creating an opening adjacent to the flaps for allowing the flowable product to be dispensed from the container; and upon removal of manual pressure, the resiliently deformable liner returns to the undeformed position.

An additional aspect of the invention comprises a peripheral wall radially disposed between the annular wall and the skirt, the peripheral wall being substantially perpendicular to the skirt. A further aspect includes the closure comprising an annular ring on an interior surface of the peripheral wall, for engaging the resiliently deformable liner between the closure and the container.

In another aspect, the invention includes a cap that engages the closure.

In other aspects, when in the actuated position, the flaps do not extend past the mouth of the dispensing portion.

Other aspects include a closure system such that, upon the return of the resiliently deformable liner to the undeformed position, the closure system provides a sealing system for the container.

In yet other aspects, the annular wall is contoured to describe a radial arc. In other aspects, the liner comprises an etched region surrounding the slits.

A second aspect of the invention relates to a dispenser for dispensing a flowable material from a container, the dispenser comprising: 1) a closure member for engaging the container, the closure member comprising: i) a top wall, ii) a skirt depending from the top wall, and iii) a spout extending from the top wall, a juncture of the spout and the top wall defining an obtuse angle; and 2) a dispensing member contacting an interior surface of the top wall, the dispensing member having a plurality of segments defined by a plurality of scored lines, each segment extending adjacent to one another in an essentially flat surface when in a closed configuration, and the segments separating from each other and extending toward the spout when in a dispensing configuration; where the segments are in the dispensing configuration when a positive pressure is applied to the container and the segments are in the closed configuration in the absence of the positive pressure.

Aspects can include a juncture of the top wall and the skirt defining a substantially right angle. Aspects can include an outer periphery of the dispensing member being continuously attached to the skirt. Additional aspects can include a protrusion depending from the top wall, the protrusion for fixing the liner between the top wall and the container. Some aspects can include a spout comprising an orifice, wherein an area defined by the orifice is equal to or greater than an area defined by an opening of the container. Some aspects include a top wall having an inner surface that is curved.

Particular aspects of the invention can include the dispensing member being chosen from the following: a plastic foamed liner, a solid plastic sheet liner, a flexible metal liner, a spring steel, and a flexible liner, and a non-flexible metal liner. Some aspects can include the spout comprising external and internal openings, the external opening being smaller than the internal opening. Some aspects can include the external and internal openings being over an opening of the container.

A third aspect of the invention relates to a dispensing closure assembly for dispensing a flowable material from a deformable container, the dispensing closure assembly including: a flow control means (such as a liner) for controlling the flow of material from the container in response to increased pressure inside the container, the flow control means comprising one or more movable portions, the flow control means being arranged such that, upon an increase of pressure inside the container, the movable portions move to define an opening adjacent to the movable portions thereby allowing the material to be dispensed from the container; and a closure having an opening, a sloping collar configured around the opening, and a skirt depending from the top wall, the closure configured between the flow control means and the container such that, upon increased pressure inside the container, the movable portion contacts the sloping collar.

Some aspects can include the contoured top wall defining a rounded shape.

Additional aspects can include the contoured top wall consisting of: i) an orifice; ii) a central portion surrounding the orifice; and iii) an outer portion surrounding the central portion, the outer portion joining the skirt; such that the contoured top wall provides a convex shape to an outer surface of the top wall.

Additional aspects can include the sloping collar defining a frustum. Some aspects can include the flow control means being attached to the closure.

BRIEF DESCRIPTION OF THE DRAWINGS

The features of the present invention which are believed to be novel are set forth with particularity in the appended claims. The drawings may not be to scale. The invention can best be understood by reference to the following description taken in conjunction with the accompanying drawings.

FIG. 11 A shows a perspective view of a liner in an unactuated position, and FIG. 11 B shows a perspective view of a liner in an actuated position;

FIG. 12A shows a perspective view of a liner with slits contacting a coined region, the liner in an unactuated position, and FIG. 12B shows a perspective view of a liner with slits located within a coined region, the liner in an actuated position;

FIG. 13A shows a perspective view, FIG. 13B shows a cross-sectional view of a coined region having a U-shaped profile, FIG. 13C shows a cross-sectional view of a coined region having a V-shaped profile, and FIG. 13D shows a close-up of a portion of FIG. 13C;

FIGS. 16A-16B show perspective views of the closure system, FIG. 16C shows a side view of the closure; and FIG. 16D shows a side view of an alternate embodiment of the closure.

DETAILED DESCRIPTION OF PREFERRED EMBODIMENTS

Figure 1A:
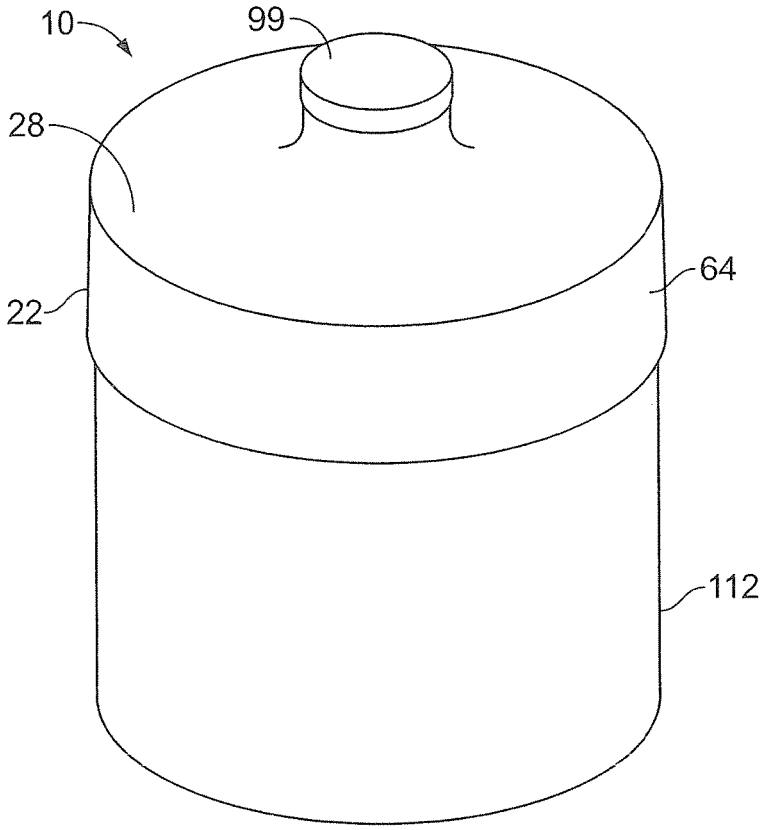
FIG. 1A shows an embodiment of a dispenser closure engaging a container.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

Referring now to the FIGS. 1-15 and particularly to FIGS. 1-4, there is shown a dispensing closure assembly or system 10 including a closure 22 and a liner 75 (or other flow control means) in a typical container cap and liner system. The dispensing closure system 10 is for use with an associated container 112, for dispensing a flowable material inside the container 112.

The closure 22 can provide a means for the dispensing closure system 10 to engage the associated container 112 and to secure the closure system 10 to the container 112. The closure 22 can also position the associated liner 75 relative to the container 112 and can secure the liner 75 to the container 112. The closure 22 can include an exterior surface 23, a surface meant to be engaged by the user when using the closure system 10, and an interior surface 25, a surface meant for communicating with the container 112; these surfaces 23, 25 are preferably on opposite surfaces of the closure 22.

As especially shown in FIGS. 2 and 7-9, the closure 22 can be formed of two portions, an upper portion 24 and a lower portion 26. The closure 22 can include a dispensing portion 52. The upper portion 24 of the closure 22 can include a top wall 28 that can be adjacent to an dispensing portion 52, with the top wall 28 attached at a right angle, transverse angle, or including an arcing portion where the top wall 28 joins the dispensing portion 52. The top wall 28 can include an interior surface 32 for communicating with the interior of the container 112 and an exterior surface 30 on the opposite surface, to be engaged by a user using the closure system 10.

The top wall 28 can include several segments disposed around the dispensing portion 52 at different distances away from the dispensing portion 52. The top wall 28 can include a segment disposed around the dispensing segment, a collar 48 that is preferably in in continuous or contiguous contact at a junction 70 where the collar 70 and dispensing portion 52 meet. In a segment disposed outside of the collar 48, a top wall 28 segment can be disposed between the collar 70 and the peripheral wall 40 of the closure 22. These segments can encircle or surround the dispensing portion 52 in successive segments or successive rings.

The dispensing portion 52 can include an aperture or orifice 54 for dispensing a flowable material out of the container 112, the orifice having an external opening 58 associated with the exterior surface 23 of the closure 22 and an internal opening 56 associated with the interior surface 32 of the top wall 28. The orifice 54 can also comprise a spout for directing the path of the flowable material as it is dispensed from the container 112.

Figure 1B:
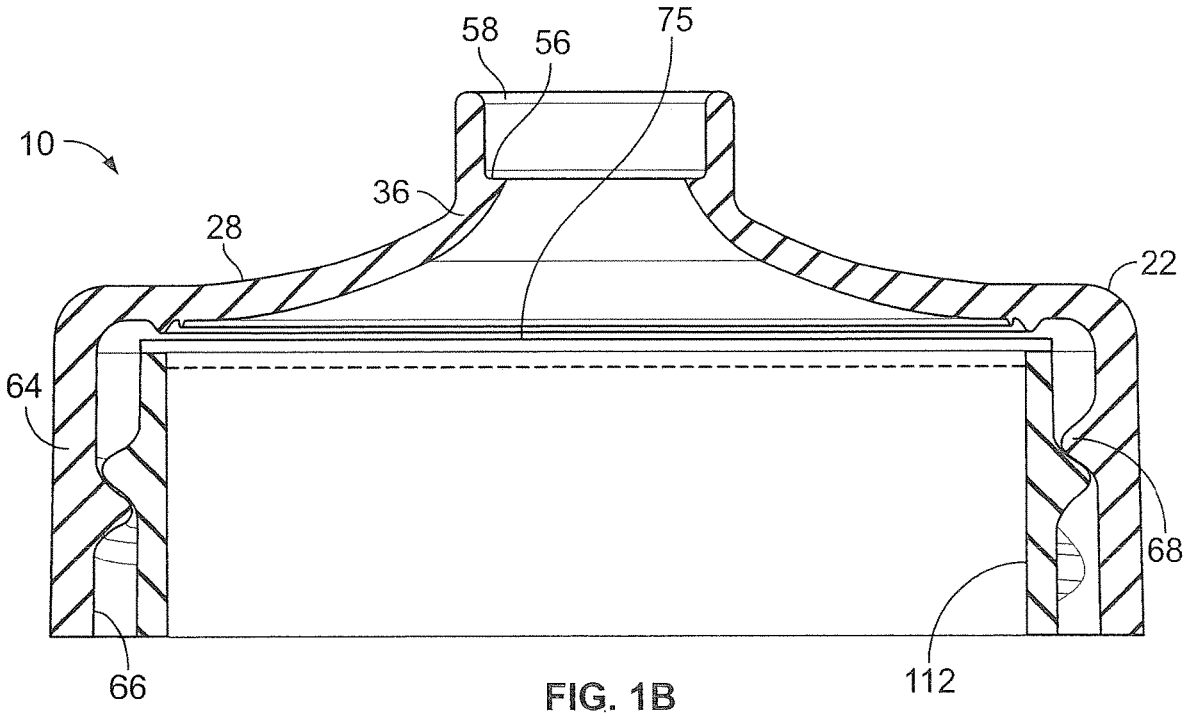
FIG. 1 B shows a side view of a cross-sectional of an embodiment of a dispensing closure assembly in an closed configuration.

As shown in FIG. 1 B, in some embodiments, the internal opening 56 can have a larger diameter (or define a larger negative area) than the external opening 58. In embodiments including a spout 52, the spout can include a cross-section that defines a diameter (or negative space) that decreases in size as the spout extends away from the top wall 28 of the closure 22.

Figure 2:
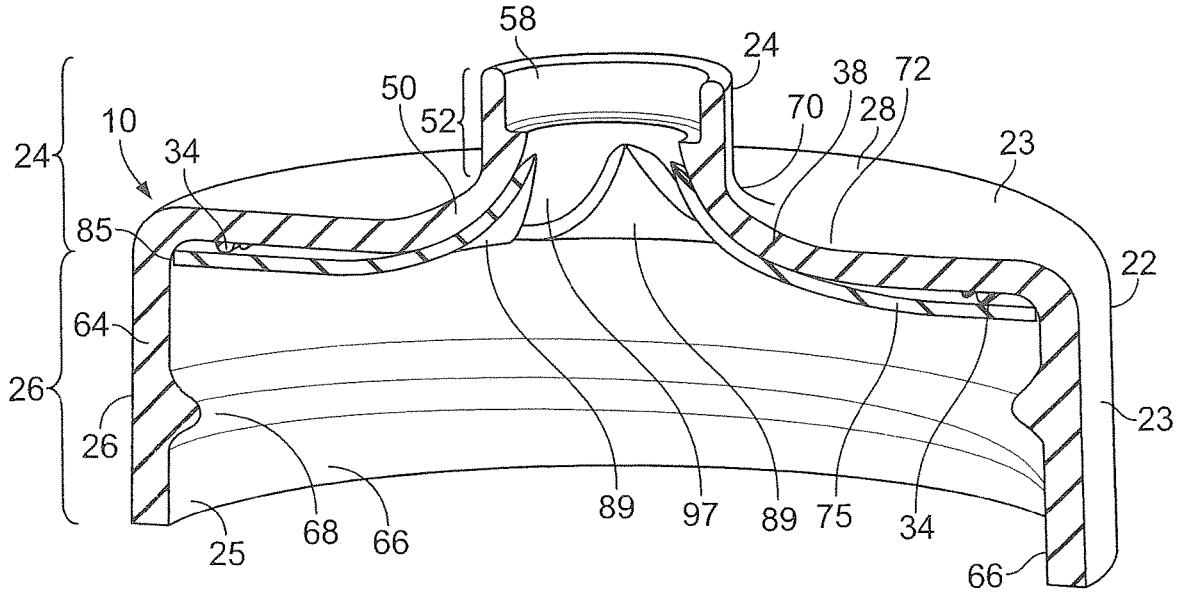
FIG. 2 shows a side view of a cross-sectional of an embodiment of a dispensing closure assembly in an open configuration.

As shown in FIG. 2, the internal opening 56 can have a smaller diameter (or define a smaller negative area) than the external opening 58, providing an expanded orifice to prevent flowable materials from building up or collecting at or near the orifice while the flowable materials are being dispensed. The internal and external opening 56, 58 can have the same diameter, which is favored where the spout 52 possesses the same diameter or profile throughout its length.

Figure 8:
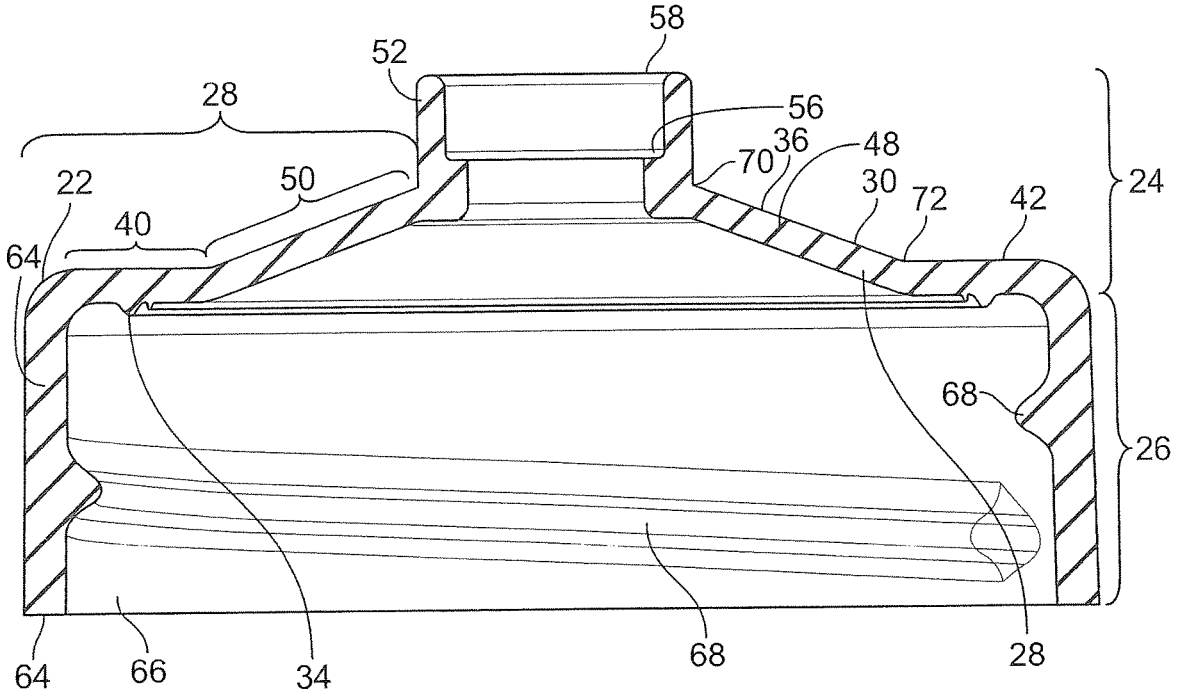
FIG. 8 shows a side view of cross-section of an embodiment of a closure having an angled collar.
Figure 9:
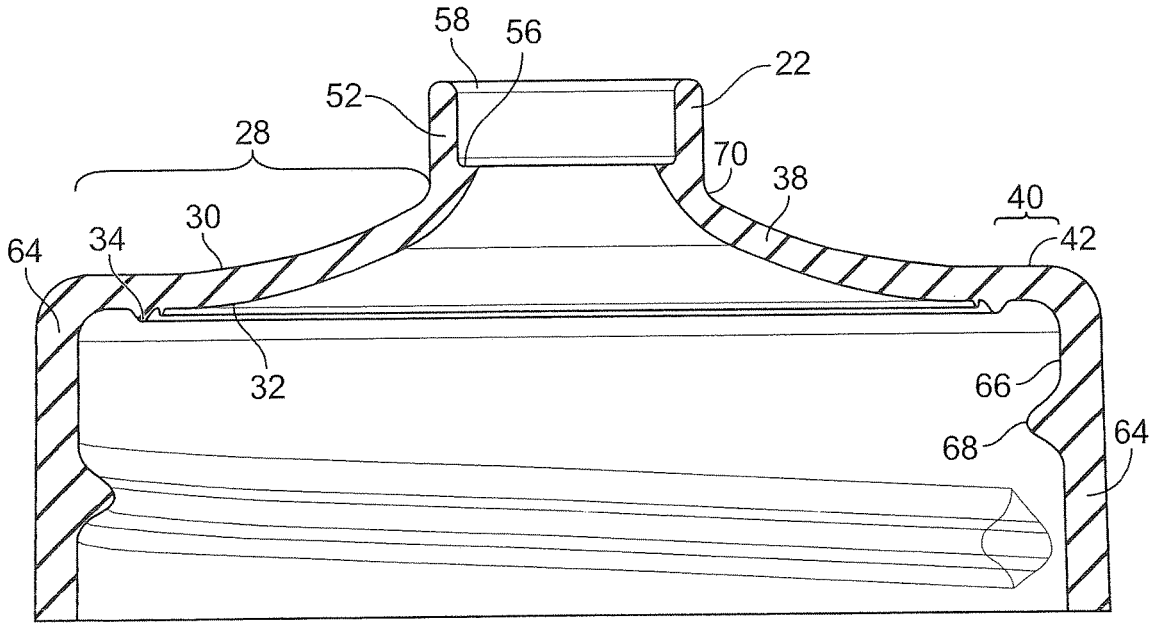
FIG. 9 shows a side view of cross-section of an alternative embodiment of a closure having a curved or arcing collar.
Figure 10:
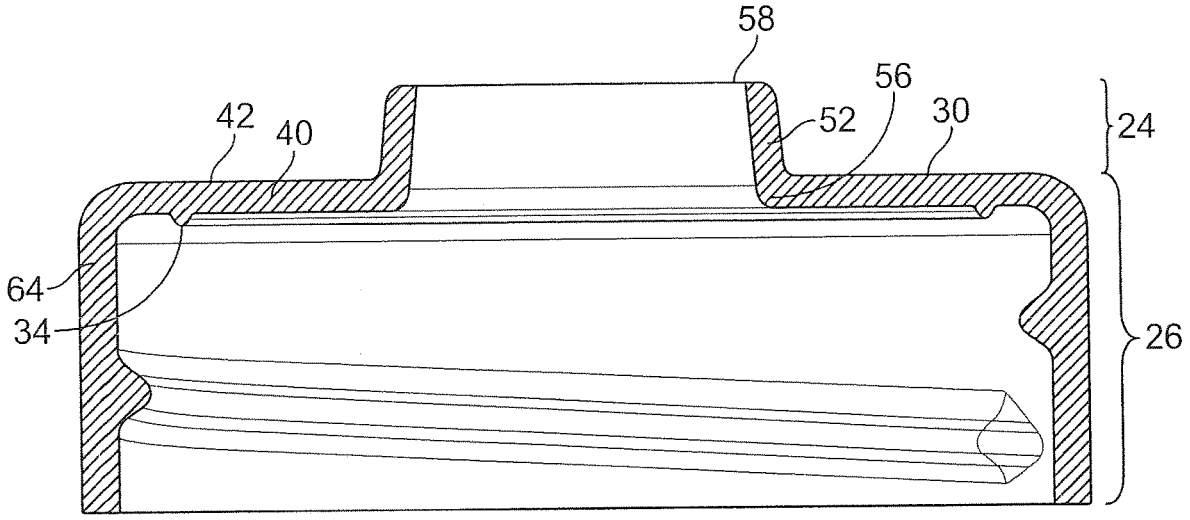
FIG. 10 shows a side view of cross-section of an another embodiment of a closure having a collar perpendicular to the skirt of the closure.

As shown in FIGS. 2 and 7-10, the top wall 28 can include a collar 48 between the orifice 54 and a peripheral wall 40. In other embodiments, such as FIG. 8, the collar 48 can slope at a different angle than that of the peripheral wall 40. The collar 48 can define a slope that angles downward and outward away from the internal opening 56 of the orifice 58 (FIG. 8) or the spout. The collar 48 can slope to define an obtuse or transverse angle at the junction 70 where it meets the dispensing portion 52. The collar 48 can be angled to define an obtuse or transverse angle at the junction 72 where it meets the peripheral wall 40. In preferred embodiments, the collar 48 defines an obtuse or transverse angle at both junctions 70, 72. The angles defined at the junctions 70, 72 can be between 90-180 degrees, 120-150 degrees, or 130-140 degrees. As shown in FIG. 9, the collar 48 can define a curving slope between the orifice 54 and the peripheral wall 40. Such curving slope can provide the exterior surface 30 of the top wall 28 with a concave shape, as shown in FIG. 9, or can provide a convex shape (e.g., hemispherical, dome, or mushroom-shaped profile or volume). As shown in FIG. 10, the collar 48 can be co-planar with the peripheral wall 40, such that the spout 52 and the top wall 28 define a right angle or substantially right angle when viewed from in profile. Here, the collar 48 can occupy a plane that is perpendicular to the dispensing portion 52 and/or the skirt 64.

The top wall 28 can define a hemispherical or dome shape or a shape similar to the cap of a mushroom. Such versions of the top wall 28 provide a strongly curved surface for the flaps to spread against when the closure system 10 is subjected to positive pressure. When the flaps 89 are in communication with the interior surface 32 of the top wall 28, such curved shape can allow the flaps 89 to attain the maximum amount of spreading and can prevent the flaps 89 from tangling or tearing. Such convex, curving shape can allow the liner 75, and especially the flaps 89 to flex and/or deform when under pressure. This feature can allow the liner 75 to return to its original position and orientation when the pressure is removed, and thus prevent leakage from the container 112. In some embodiments, this feature can provide a system in which the liner 75 can reseal itself after it has been used to provide an opening for transferring a flowable particle or material into the container 112, in some cases providing a watertight or airtight closure when the liner 75 is in its undeformed configuration.

In some embodiments, the collar 48 can describe a surface that curves or arcs (FIGS. 2, 9), rather than a surface that slopes in a substantially linear fashion (FIG. 8). As shown in FIGS. 2 and 9, where the collar 48 has an arcing surface 38, that arcing surface can be convex on the interior surface 32 of the top wall 28. For example, where the top wall 28 includes a collar 48 having an annular surface or wall 36 surrounding a round or circular orifice 58, the annular wall 36 can define a surface 38 that arcs away in a radial fashion from a central vertical axis of the closure 22. In other embodiments, the spout 52 and/or orifice 58 can define a shape that is elliptical or oval, a regular polygon (such as a square or hexagon), or an irregular shape.

This arcing surface can serve to limit or restrict the degree of movement of the liner 75 when pressure is applied to the container 112. That is, when pressure is applied to the container 112, the liner 75 defines flaps or segments 89 can distend or move toward the dispensing portion 52. The interior surface of the collar 48 can provide a physical barrier to limit the degree of movement by the flaps 89, so that the flaps are able to return to their original places or positions or orientations when the applied pressure is removed from the container 112.

It is preferred that the orifice 58 range have a diameter or major axis equal to or greater than $^{50}/_{1000}$ (0.050 inches). In preferred embodiments, the smallest orifice diameter could be 0.050 inches and the largest could be 2.0 inches. In certain large-scale industrial or commercial applications, a larger orifice is contemplated, as large as several inches or several feet in diameter.

The diameter of the orifice 58 of the dispensing portion 52 can be greater or larger than the length of the one or more slits 87. For this purpose, the length of a slit 87 can be considered to be the length of the longest uninterrupted or continuous portion defined by the slit 87.

Figure 12A:
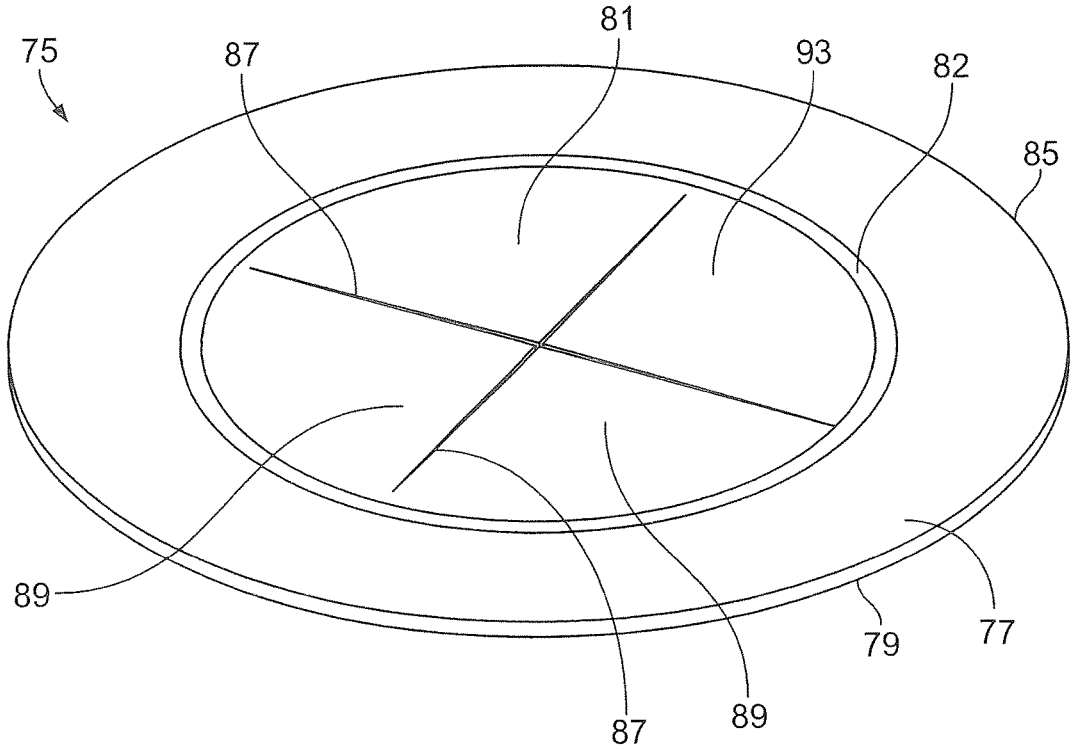
FIGS. 12A-12B show views of a liner.
Figure 12B:
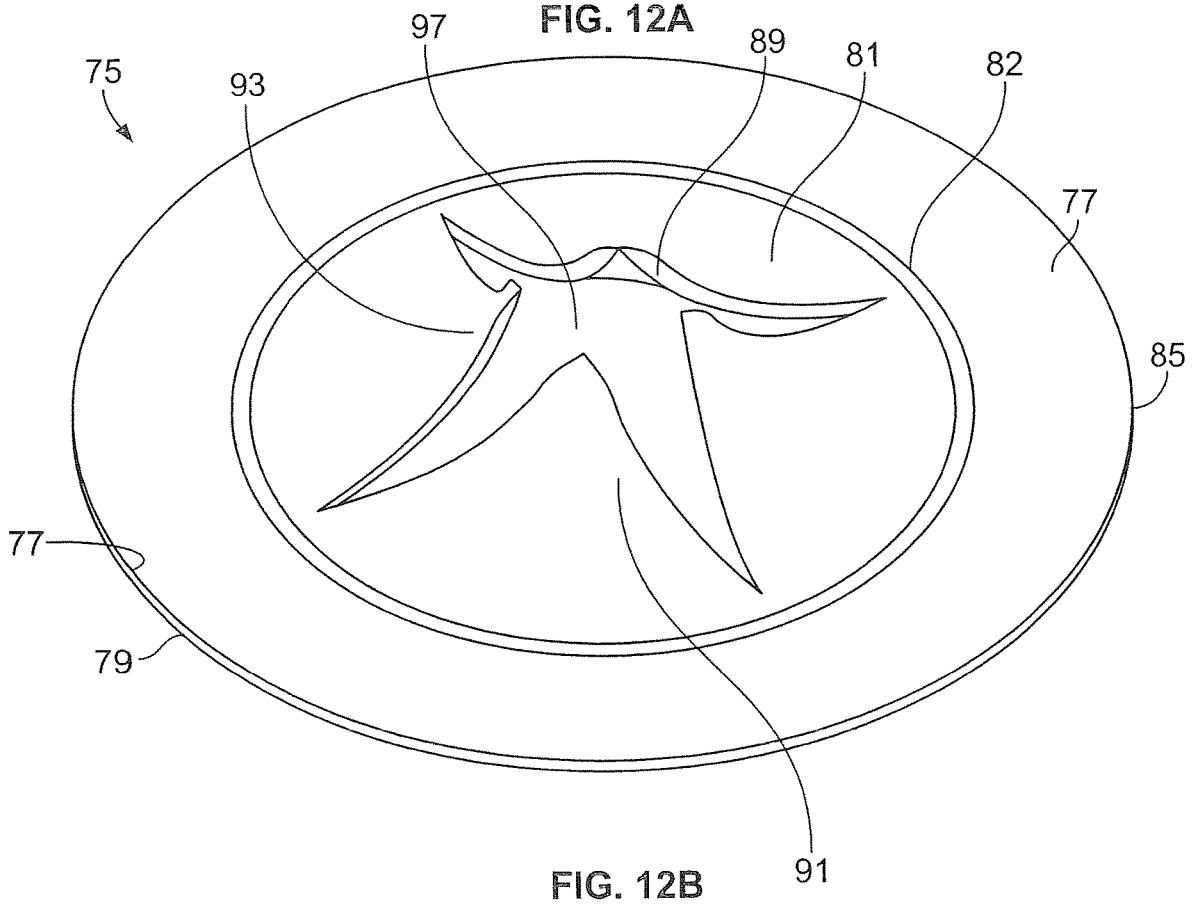

For example, in FIGS. 12-13, a pair of slits 87 can intersect to form four tabs or flaps 89. Alternatively, a single four-armed slit 87 can define four tabs or flaps 89.

Some embodiments can include a top wall 28 having a collar 48 between the top wall 28 and a skirt 64 depending from the top wall 28, but no peripheral wall 40 between the collar 48 and the skirt 64. In embodiments as shown in FIGS. 2 and 8, the collar 48 can form a surface that can be characterized as a frustum or generally frustoconical in contour or shape. The frustum 50 can have its widest or largest portion adjacent or near the skirt 64, and its narrowest or smallest portion adjacent or near the orifice 54.

As shown in FIGS. 1-2 and 8-9, the lower portion 26 can include a skirt 64 positioned generally perpendicular to the top wall 28, although the structures 64, 28 can be at about 70-110 degrees to one another or parallel, as will be explained. The lower portion 26 can include a thread 68 on the inner surface 66 of the closure 22, such as the skirt 64, for engaging a complementary thread on the container 112. The exemplary container 112 can have a container thread with a finish 114 (FIGS. 14A, 15) that defines the mouth 112 of the container 112. It will be recognized by those skilled in the art that the closure system 10 described herein can also be used with containers having a snap-like or beaded engagement configuration, or other engagement configurations known in the field.

In some embodiments, the top wall 28 can be disposed around the orifice 54 so that the orifice 54 is in the center of the top wall 28, such as shown in FIG. 2. Particularly where the dispensing portion 52 is round or circular in shape, the top portion can include a collar 48 surrounding the orifice 58, where the collar 48 is disposed between the orifice 54 and the skirt 64. In some embodiments, the top wall 28 can include an outer edge or peripheral wall 40 to the skirt 64, and that peripheral wall 40 can be substantially perpendicular to the skirt 64. The peripheral wall 40 can include a substantially flat outer surface 42.

Where the top wall 28 of the closure 22 is round or oval in its shape or outline, the collar 48, peripheral wall 40, and/or skirt 64 can be radially arranged around the dispensing portion 52.

The dispensing closure system 10 can further include a liner 75 positioned against the interior surface 32 of the top wall 28 of the closure 22, as shown in FIGS. 1-7. The liner 75 provides a means initiating and controlling the movement of flowable materials out of the associated container 112. The liner 75 can be attached or connected to the closure 22, or can be positioned against the closure 22 and be removed as desired.

The liner 75 can be fashioned to have the same general shape or outline as the top wall 28, with an upper surface 77 for facing and/or communicating with interior surface 32 of the top wall 28. The liner 75 can have a lower surface 79, opposite the upper surface 77, for facing and/or communicating with the container 112.

When the dispensing closure system 10 is secured to the container 112, the liner 75 can be positioned between the closure 22 and the container 112. In some embodiments, the liner 75 can be compressed between the closure 22 and the container 112.

As shown in FIGS. 2 and 7-9, the liner 75 can be secured between a) the finish 114 around the mouth 112 of the container 112, and b) a corresponding sealing portion 34 that protrudes from the interior surface 32 of the top wall 28 of the closure 22. That is, the sealing portion 34 can define a protruding structure that mirrors the structure of the mouth of the container 112. For example, to accommodate a round or circular mouth, the sealing portion 34 can define a round or circular or annular or ring-shaped protrusion depending from the interior surface 32 of the top wall 28. The top wall 28 can include one or more sealing portions 34 that align with the finish 114 so that the liner 75 is secured between the sealing portion 34 of the top wall 28 and the finish 114 of the container 112 when the dispensing closure system 10 is secured to the container 112. Alternatively, the finish 114 can be fastened or fixed in place between one or more corresponding grooves or depressions in the top wall 28.

The sealing portion 34 on the interior surface 32 of the top wall 28 can act in concert with the finish 114 of the container 112 to position the liner 75 to form a barrier or a seal between the container 112 and the closure 22, or to simply position the liner 75 against the container 112. A first, upper surface 77 of the liner 75 can be secured by the sealing portion 34 of the top wall 28 of the closure 22, while a second, lower surface 79 of the liner 75 can be secured by the finish 114 of the container 112.

In embodiments where the container 112 has a round or circular mouth defined by a round or circular finish 114, and the dispensing closure system 10 has a round or circular top wall 28, the liner 75 can be secured between the round finish 114 and a correspondingly round or annular sealing portion 34 that protrudes from the interior surface 32 of the top wall 28 of the container 112. The sealing portion 34 can be present as a single annular ring, configured to have a substantially similar shape and size as the finish 114 of the container 112. As an alternative, multiple sealing portions 34 can define an overall annular or ringlike shape with spaces between individual portions that secure the liner 75 against the finish 114 of the container 112.

An upper surface 77 of the liner 75 can be attached to the one or more sealing portions 34 of the closure 22 and/or the inner surface 66 of the skirt 64 of the closure 22. In some embodiments, the liner 75 can be positioned adjacent and closely fitted to the top wall 28 or skirt 64, but not attached or secured to the closure 22; there, the liner 75 is secured when the closure system 10 is secured to the container 112.

Figure 5:
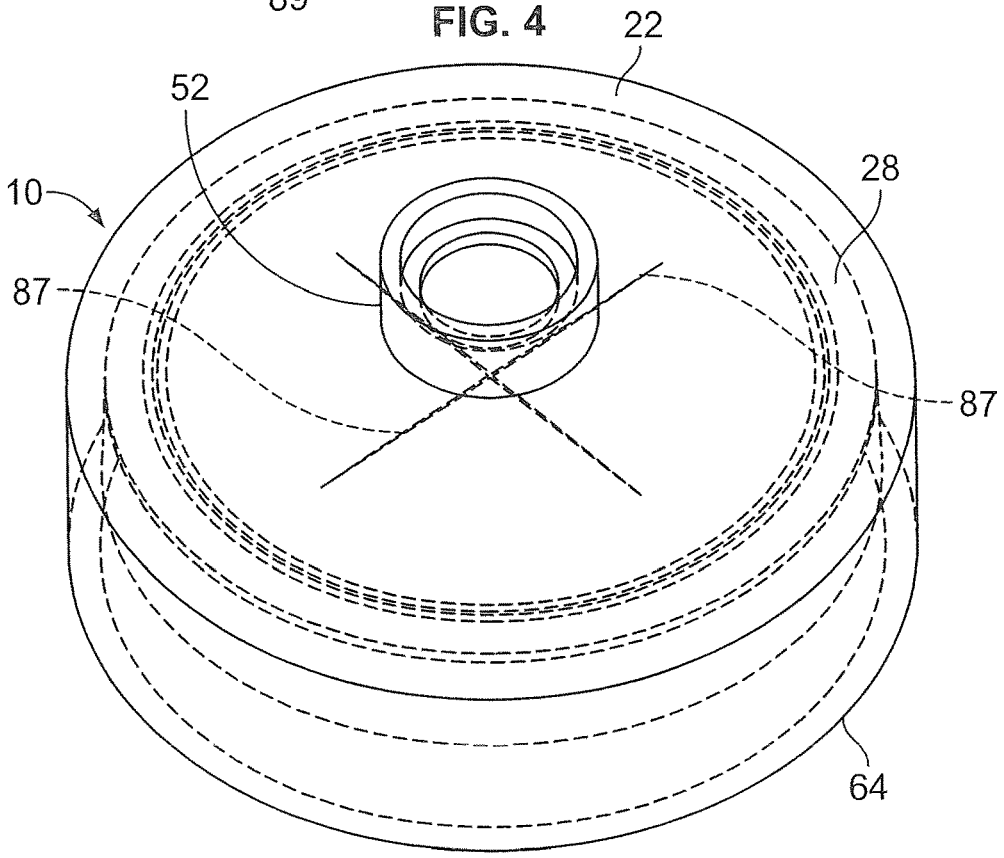
FIG. 5 shows a top perspective view of an alternative embodiment of a dispensing closure assembly in a closed configuration.
Figure 6:
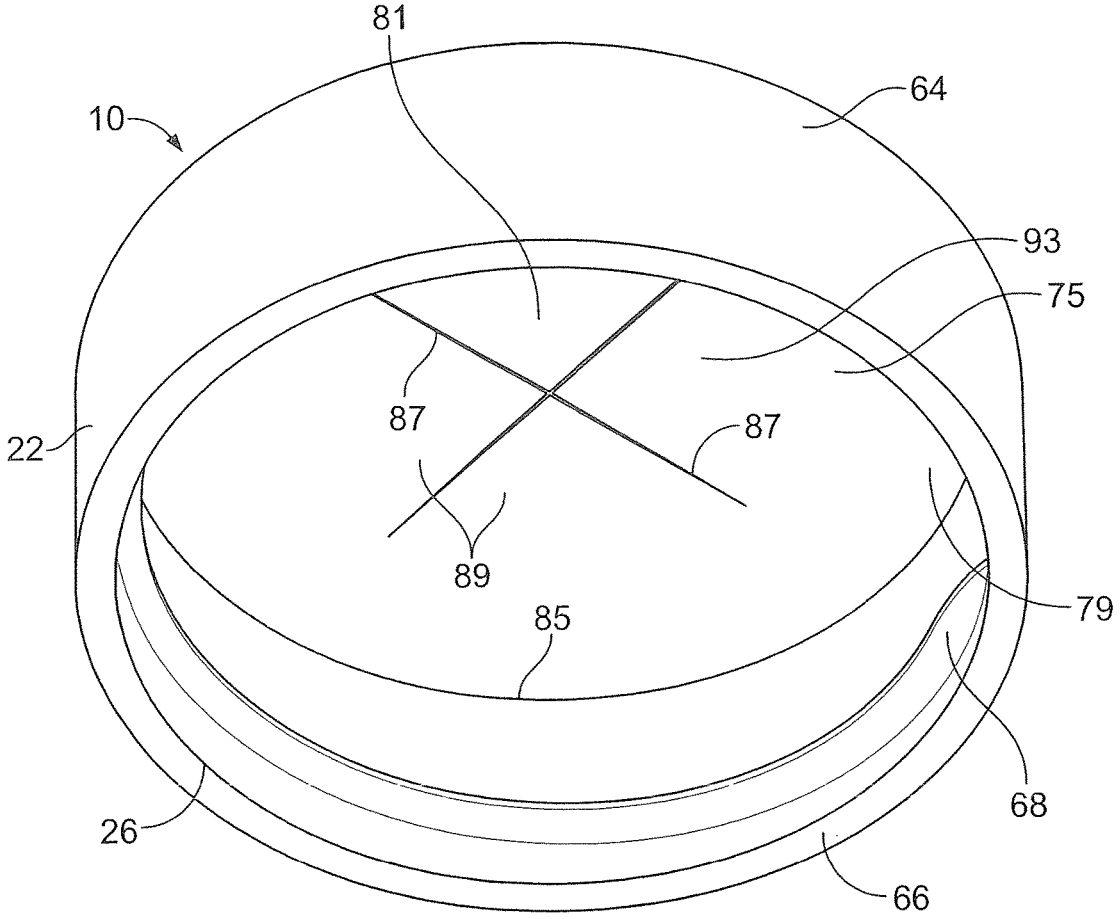
FIG. 6 shows a bottom perspective view of an embodiment of a dispensing closure assembly.
Figure 7:
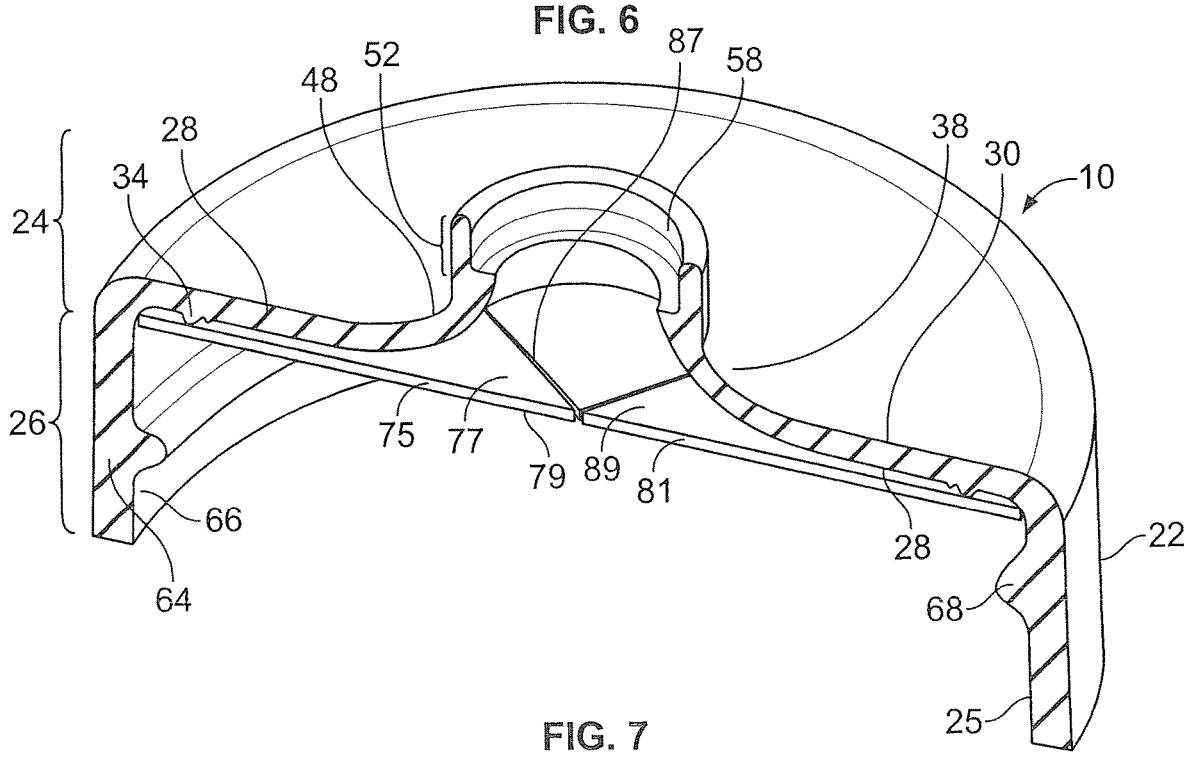
FIG. 7 shows a side perspective view of a cross-section of a dispenser closure in a closed configuration.

In some embodiments, such as shown in FIGS. 5-6, the liner 75 can also have an outer periphery 85 that extends to the inner surface 66 of the skirt 64. The outer periphery 85 of the liner 75 can be attached to the inner surface 66 of the skirt 64. In other embodiments, the outer periphery 85 could extend past the finish 114 and toward the inner surface 66, but possess a length that causes it to approach, but not contact the outer periphery 85. A portion of the liner 75 can be attached or joined to a portion of the interior surface 32 of the top wall 28, for example, a portion near the peripheral wall 40. It is preferred that the liner 75 covers the mouth 112 of the container 112 and extends past the mouth of the container 112.

The top wall 28 can be spaced at least 1 to 5 mm above the liner 75, thereby leaving space between the top wall 28 of the closure 22 and upper surface 77 of the liner 75, as shown in FIG. 2.

The liner 75 can be made from any suitable material, such as a plastic foamed liner, solid plastic sheet liner, flexible metal liner (e.g., foil), spring steel flexible liner, or a non-flexible metal liner specifically shaped to dispense with little deflection of the liner. The liner 75 can be formed from a laminate material having a resilient or flexible layer, a foil or like gas-impermeable layer, and/or a heat activated bonding layer, such as a heat activated adhesive. The resilient layer can be a closed cell foam material, chip board, or paper backed and/or coated.

The liner 75 can be relatively impervious to the environment and establish a substantially air tight and/or water tight seal between the container contents and the environment.

Figure 11A:
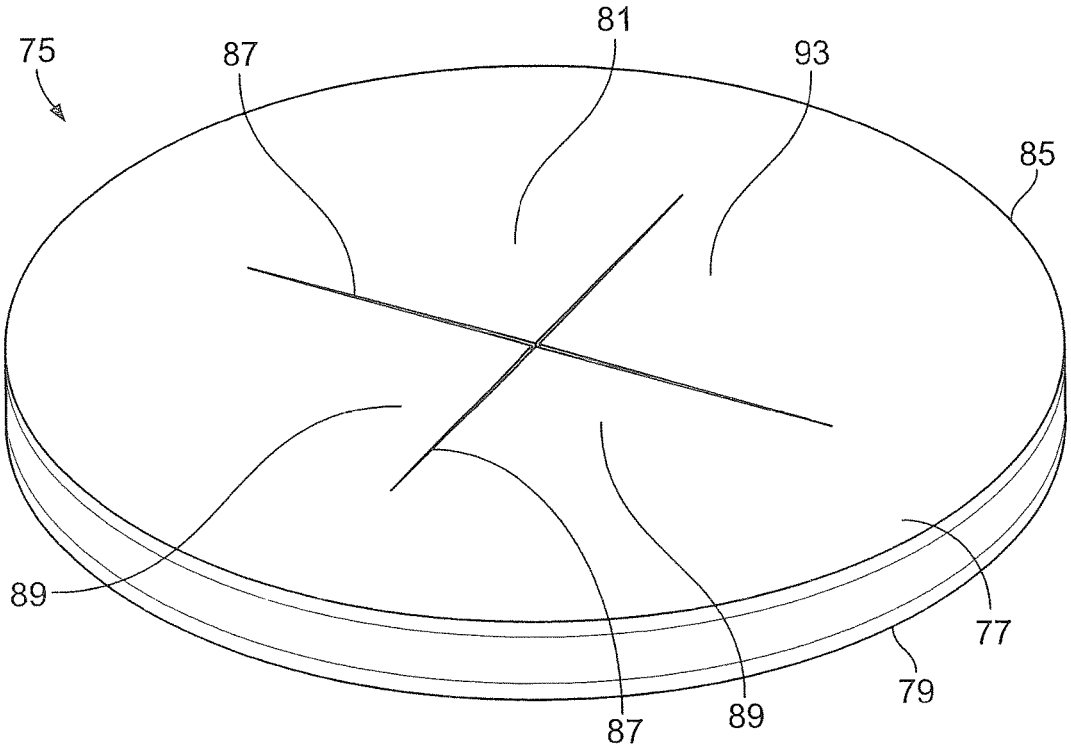
FIGS. 11 A-11 B show views of a liner.
Figure 11B:
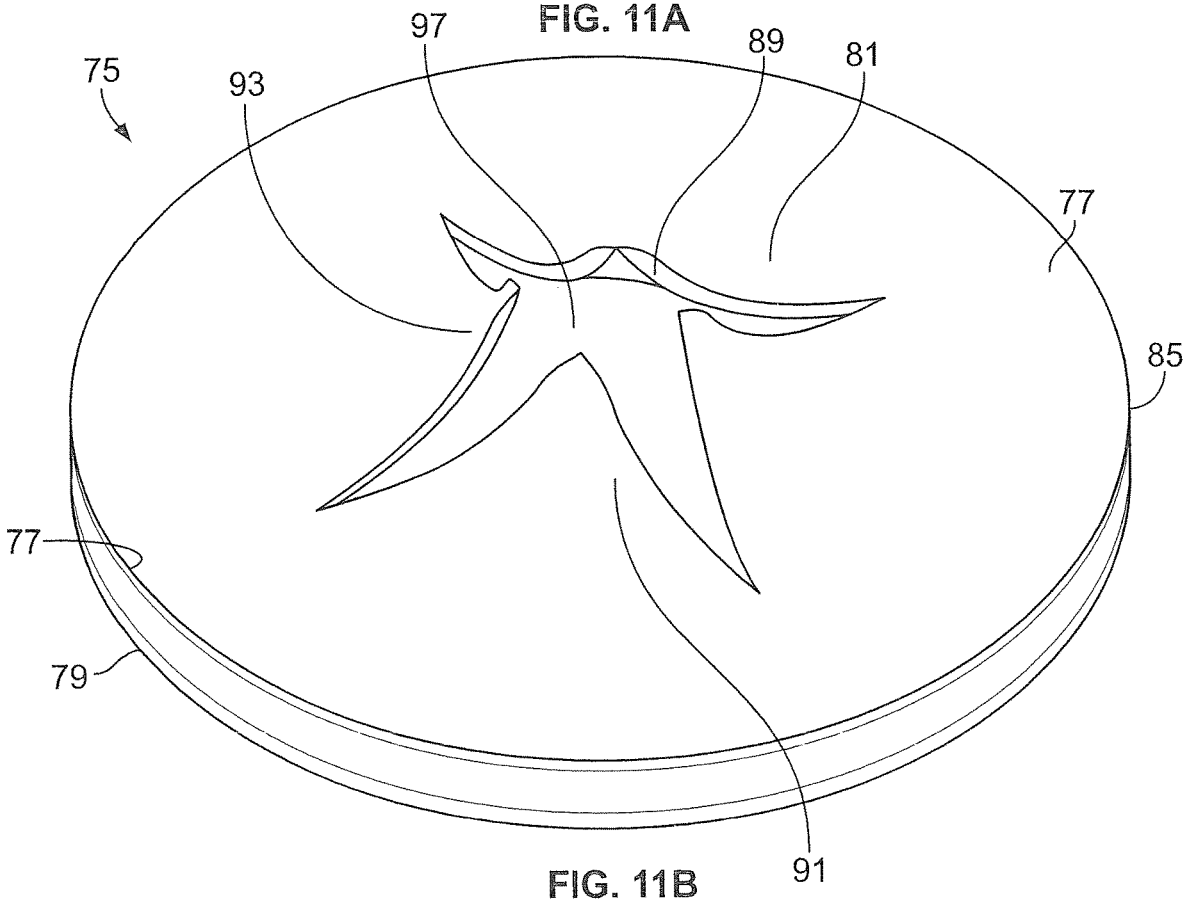

As shown in FIGS. 10-11, the liner 75 can have one or more slits 87, shaped cuts, or scored lines or regions that define two or more flaps 89 or segments or tabs; the slits 87 are preferably located in an interior or central region 81 of the liner 75. The liner 75 can include a flexible member 93 including the slits 87. Each slit 87 can intersect with one or more other slits or be separate from other slits. The shape and dimensions of the slits 87 can be varied to enable a variety of closures systems to be produced with liners suitable for controlled dispensing of a wide range of products of different viscosities and containing particulate matter of various sizes. It is preferred that the slits 87 define a figure having radial symmetry (e.g., a cross having arms of equal length or a six-armed star). It is also preferred that all of the flaps 89 possess the same shape and/or size.

For example, the liner 75 can have a plurality of slits 87 spaced radially outward so that the segments 89 formed between the radially spaced slits 87 can flex and deform so that products which can flow too freely through a larger opening 97 will be restrained to flow less freely through a smaller opening 97 and the slits 87 but if a larger flow is desired and the container 112 is able to be squeezed to apply pressure to dispense product then the segments 89 formed between the radially spaced slits 87 can flex outwards under the pressure and cause at least the opening 97 and adjacent portions of the radially spaced slits 87 to expand and allow a product or flowable material to flow more freely.

As shown in FIGS. 12-13, the liner 75 can include a segment or region positioned or disposed to encircle or surround the slits 87, called a coined region 82. This coined region 82 is preferably positioned between the slits 87 and the outer periphery 85 of the liner 75. Where the liner 75 has a circular or oval shape or periphery, the coined region 82 can similarly define a coined region 82 circular or oval having a circular or oval shape or outline, but of a smaller size or periphery. However, the coined region 82 and the liner 75 need not possess similar shapes or outlines. The coined region 82 can form a regular polygon, such as a hexagon, square, circle, or have an irregular shape.

The outer edge or perimeter of the coined region 82 be defined by a scored or etched depression 86 in the upper and/or lower surfaces 77, 79 of the liner 75. The depression or coined groove 86 can define the perimeter or periphery of the coined region 82.

Figure 13A:
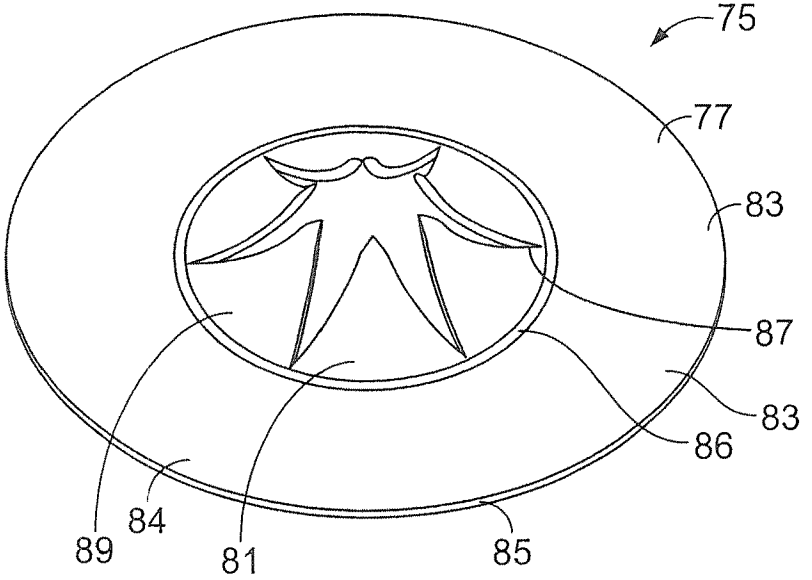
FIGS. 13A-13D show views of slitted liners in an actuated position.
Figure 13B:
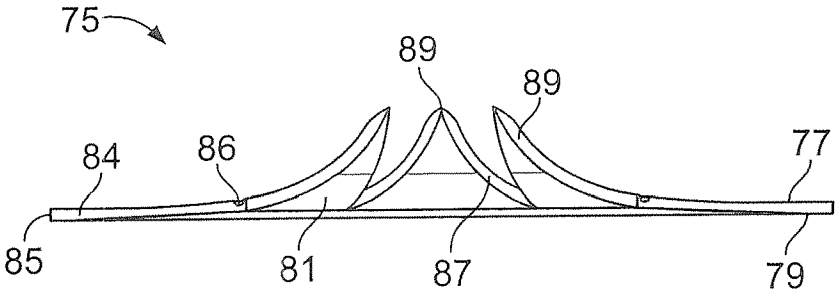
Figure 13C:
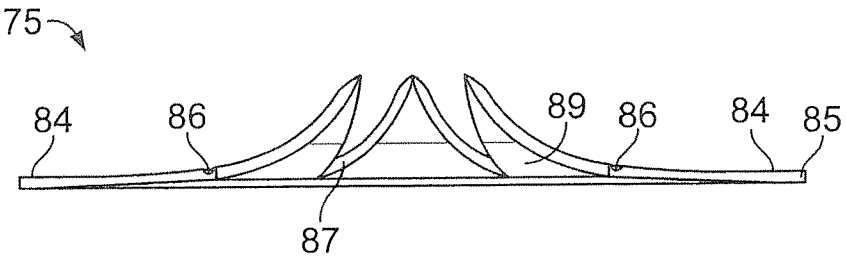
Figure 13D:
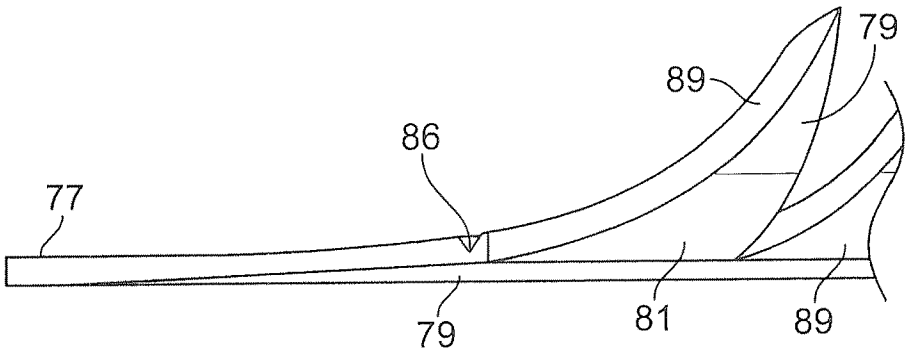

The coined groove 86 can be stamped into the liner 75. The coined groove 86 can be defined by complete or partial cuts or incisions into the liner 75. Where the coined groove 86 is scored to an intermediated depth in the slotted line 75, the coined groove 86 can have a profile (or define a depression or groove) that is U-shaped in profile (FIG. 13B). In other embodiments, the coined groove 86 can define a V-shaped or triangular depression or furrow (FIGS. 13C-13D). The coined groove 86 can have a profile that defines other shapes in profile, such as a square or rectangular shape.

In some embodiments, the coined region 82 can be a reinforced region in the liner 75 or a region having a greater thickness than the central region 81 of the liner 75 and/or the periphery 85 of the liner 87.

The coined groove 86 can possess a width and shape that creates a structure that produces strength in the liner 75. The coined region 82, whose periphery can be defined by the coined groove 86, can be narrower or wider than the width of the slits 87. It is preferred that the coined groove 86 have a width that is between 25/1000 (0.025 inches) and up to 500/1000 (0.500 inches).

The coined region 82 can encompass or enclose the slits 87 or flaps 89 so that none of the slits 87 or flaps 89 contact the coined groove 86. The coined groove 86 can encompass or enclose the slits 87 or flaps 89 so that one or more of the slits 87 or flaps 89 contact the coined groove 86. In preferred embodiments, the coined region 82 and the slits 87 can define a figure having radial symmetry, such as a circle enclosing a cross, or an oval enclosing a three-armed star.

The coined groove 86 can define a continuous, contiguous, or unbroken line or path around the slits 87 or flaps 89. The coined region 82 can include a series or plurality of shapes that, taken together, define a structure surrounding the slits 87 or flaps 89.

The coined region 82 can serve to prevent the liner 75 from tearing while in use, particularly while the closure system 10 is subjected to the application of positive pressure, or when the closure system 10 is subjected to changes in air pressure. The coined region 82 can isolate a central portion 81 of the liner 75 from the outermost remainder of the liner 75. The coined region 82 can strengthen the tabs 89 when dispensing liquids that are viscous or contain granules or particles.

Figure 14A:
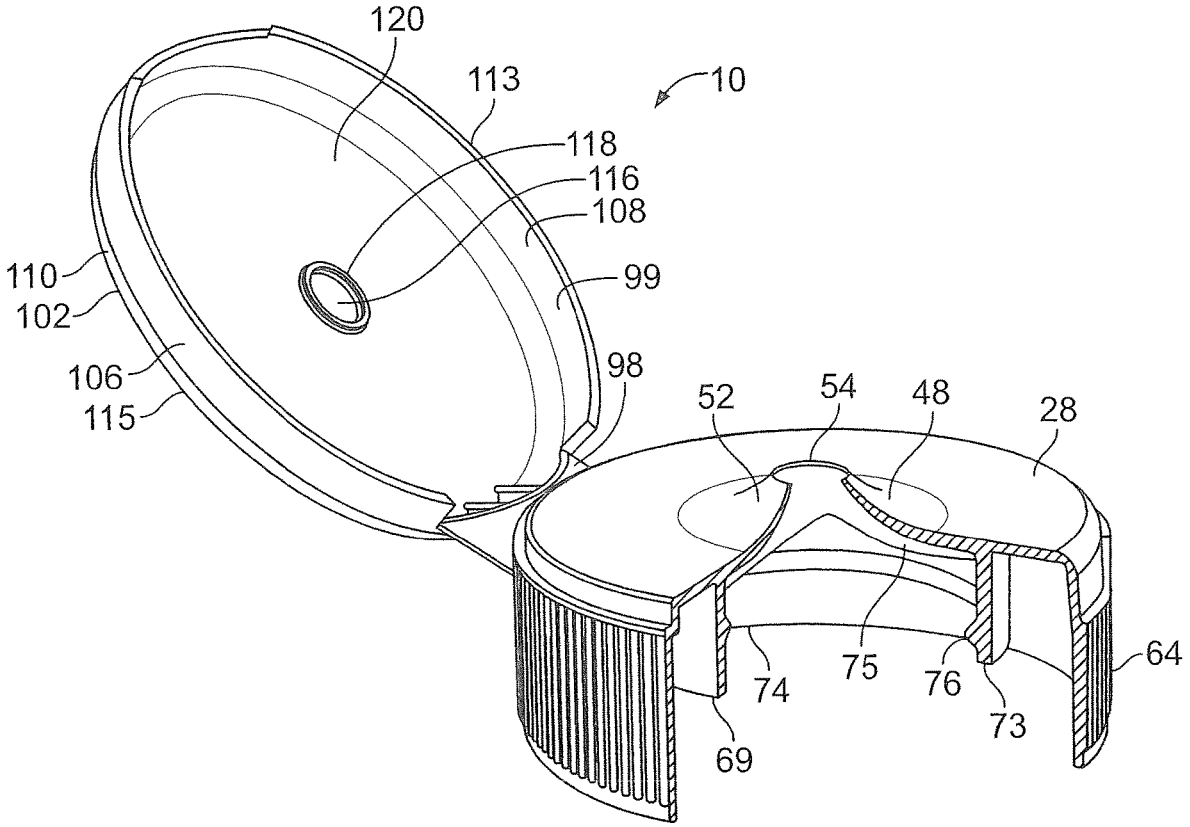
FIGS. 14A-14B shows a perspective view of an embodiment of the closure system including a hinged cap, with the cap in an open position (FIG. 14A) and a cross-sectional view of the closure along an axis that does not intersect the hinged portion of the hinged cap (FIG. 14B)
Figure 14B:
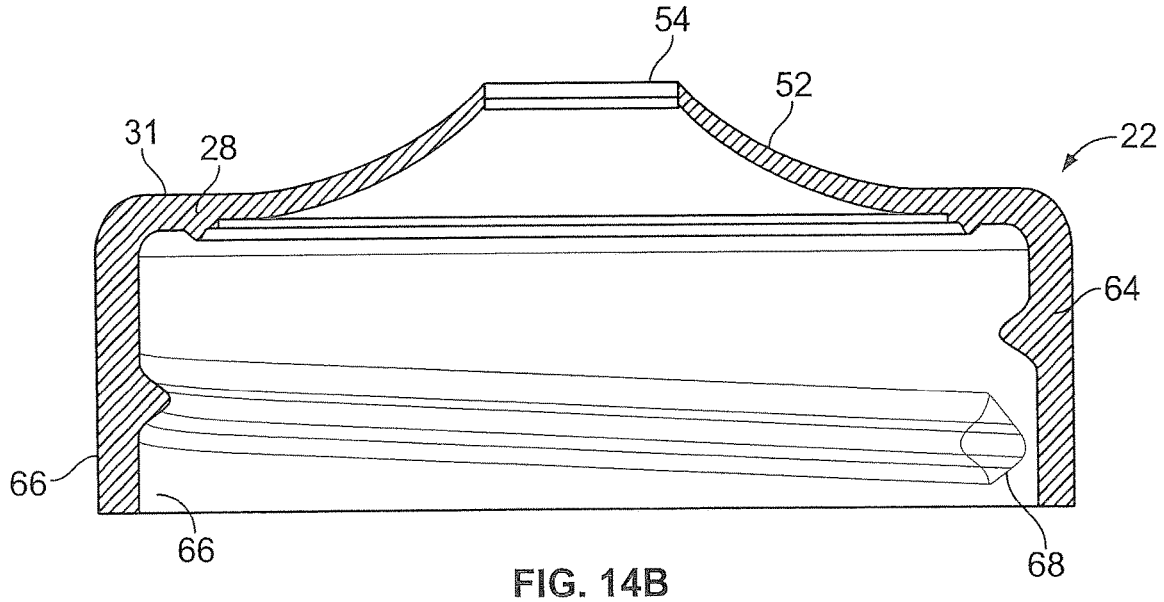
Figure 15:
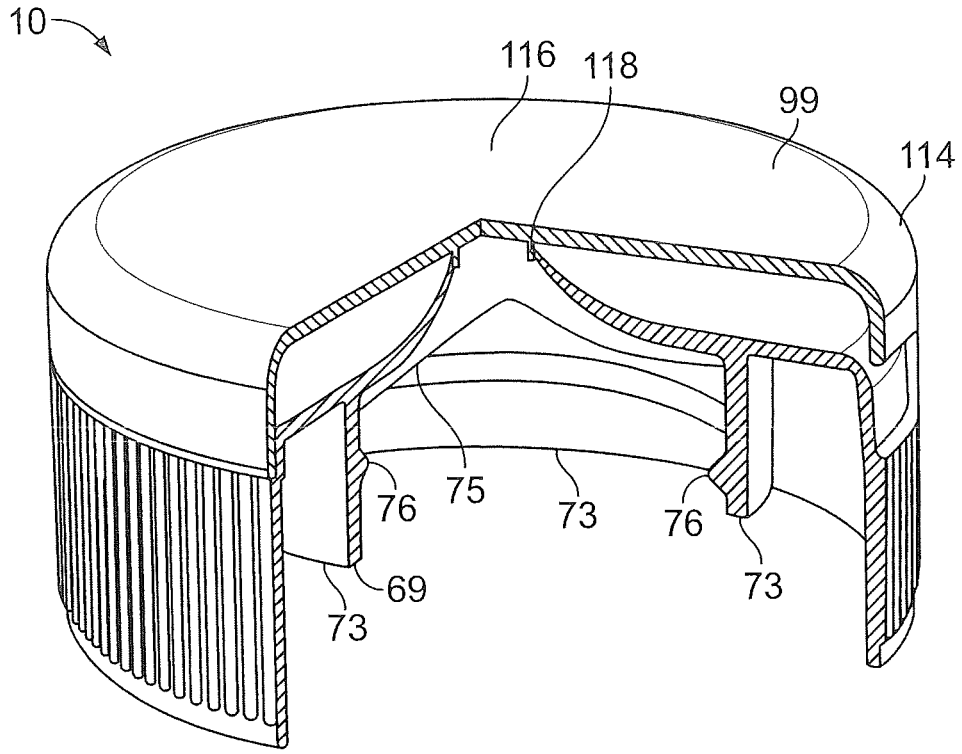
FIG. 15 shows a perspective view of FIG. 14A, with the cap in a closed position.
Figure 16A:
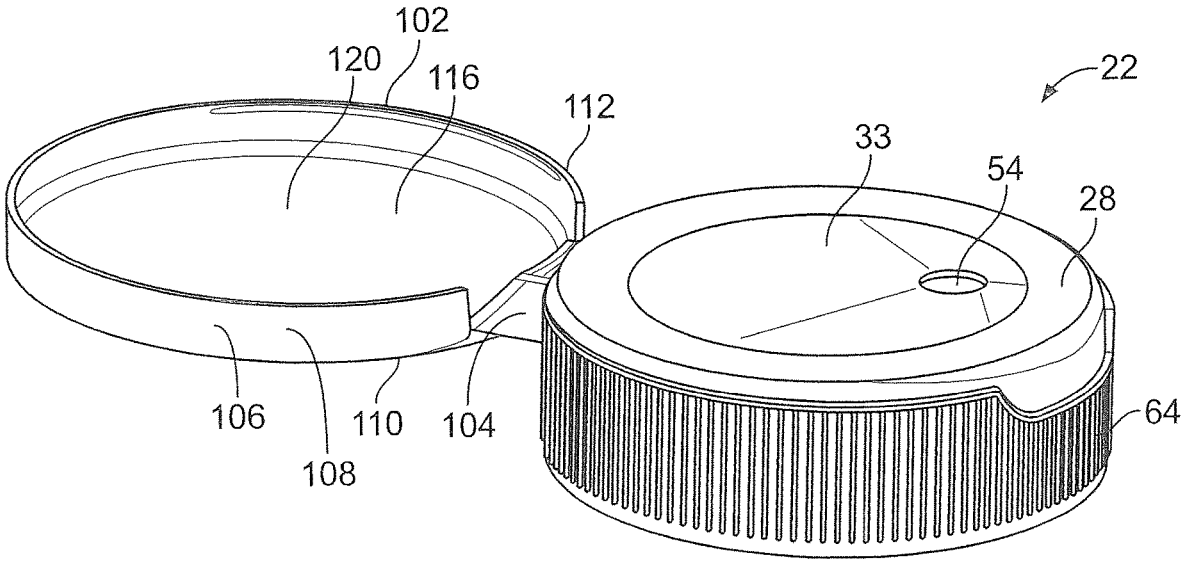
FIGS. 16A-16D show views of an alternative embodiment of the closure system including a hinged cap, with the cap in an open position.
Figure 16B:
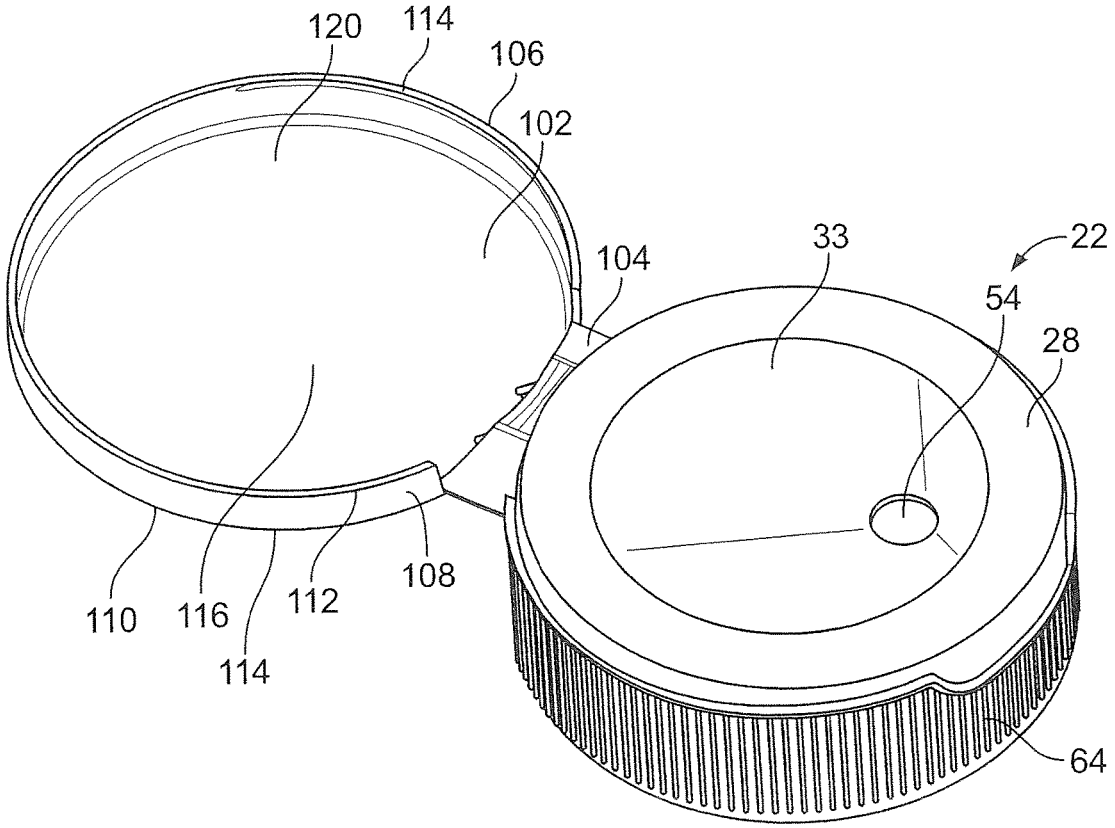
Figure 16C:
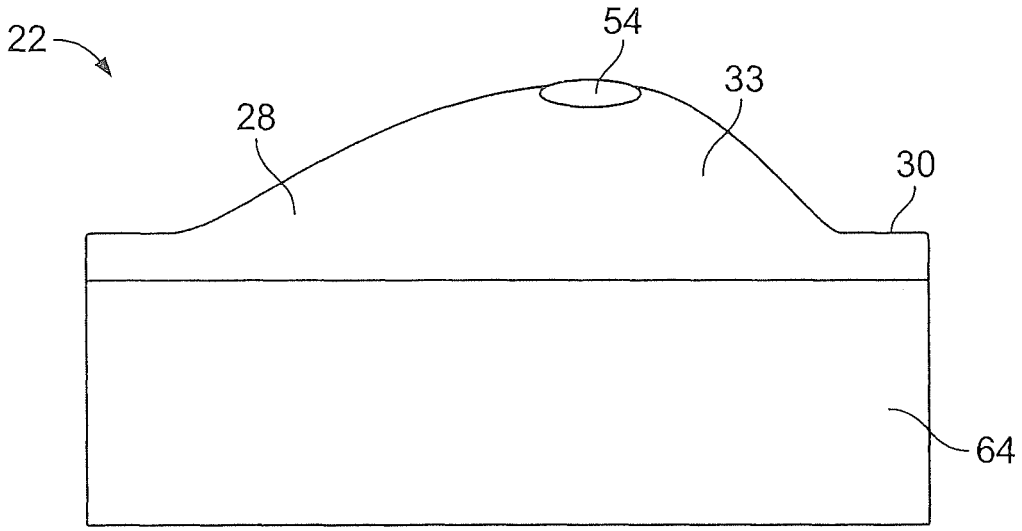
Figure 16D:
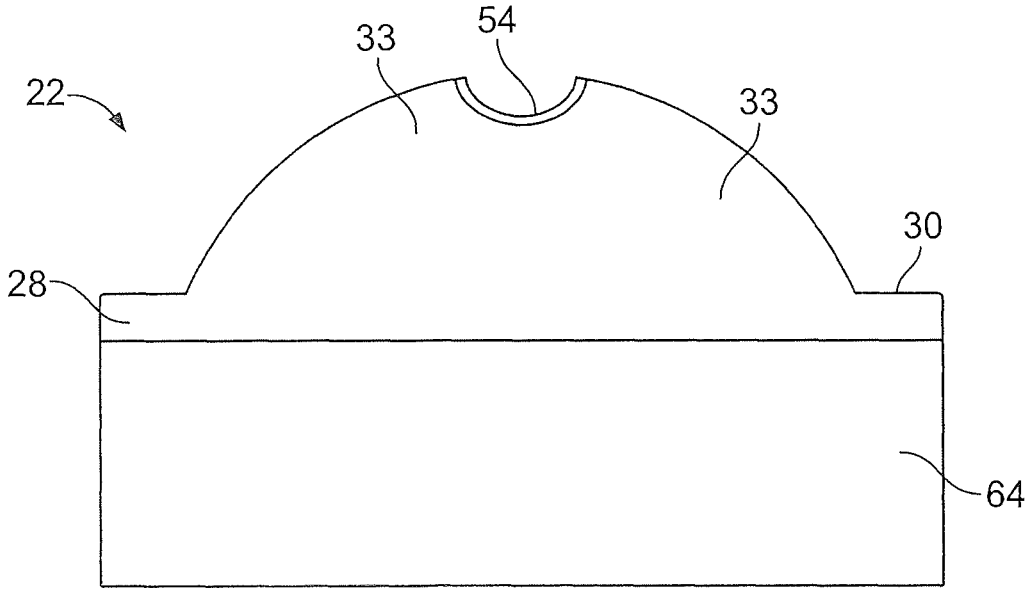

As shown in FIGS. 14-15, the closure system 10 can include a cap 102 attached to a portion of the skirt 64, with a hinged portion 104 joining or connecting the cap 102 to the closure 22. One end of the hinged portion 104 can attach to the closure 22 on the outer surface 65 of the skirt 64, while the opposite end of the hinge portion can attach to the cap 102. The cap 102 can include a cap top wall 104 from whose periphery 106 depends a cap skirt 108. The top edge 110 of the cap skirt 108 can join or connect to the cap top wall 104. The opposite bottom edge 113 of the cap skirt 108 can define a cap rim 115. The cap rim 115 can communicate with the periphery of upper edge of the closure skirt 64 when the cap is in a closed configuration with respect to the closure 22. The top wall 104 can include a central portion 116, located within the periphery 106 of the cap 102. The central portion 116, which can be encircled or surrounded by the periphery 106, can include a projection or protrusion on its interior surface; that protrusion can define an interior plug 118.

The interior plug 118 can define a projection that can communicate with the orifice 58 of the dispensing portion 52. In some embodiments, the interior plug 118 can engage the orifice 58 when the cap 102 is in a closed configuration with respect to the closure 22. In preferred embodiments, the interior plug can sealingly engage the closure 22 when in the closed configuration.

In some embodiments, the cap 102 can lack an interior plug 118 altogether, and in the closed configuration, the orifice 58 can contact the interior surface 120 of the top wall 102. In other embodiments, the dispensing portion 52 can possess a height such that neither the orifice 58 nor the dispensing portion 52 contact the contact the interior surface 120 of the top wall 102 when the cap 102 is closed upon the closure 22.

As shown in FIGS. 14-15, the closure system 10 can include an internal wall 69 depending from the inner surface 25 of the top wall 28. Like the skirt 64, the internal wall 69 can be oriented at a right or transverse angle to the top wall 28. Like the skirt 64, the internal wall 69 can define a walled structure that encloses or surrounds a central portion of the top wall 28.

As shown in FIGS. 14-15, the internal wall 69 can define an annular structure positioned within the annular structure defined by the skirt 64, and the internal wall 69 and skirt 64 can be substantially parallel to each other.

The liner 75 can be positioned within the internal wall 69, such that all of part of the outer periphery 85 of the liner communicates with an interior surface of the internal wall 69. The liner 75 can be attached or joined to the internal wall 69, or merely in contact with the internal wall 69. An internal bead 74 near a bottom edge 73 of the internal wall can prevent the liner 75 from falling out of the internal wall 28 structure, the internal bead providing a protrusion from the internal surface of the internal wall 69 for trapping the liner 75 in place with respect to the closure 22.

Figure 3:
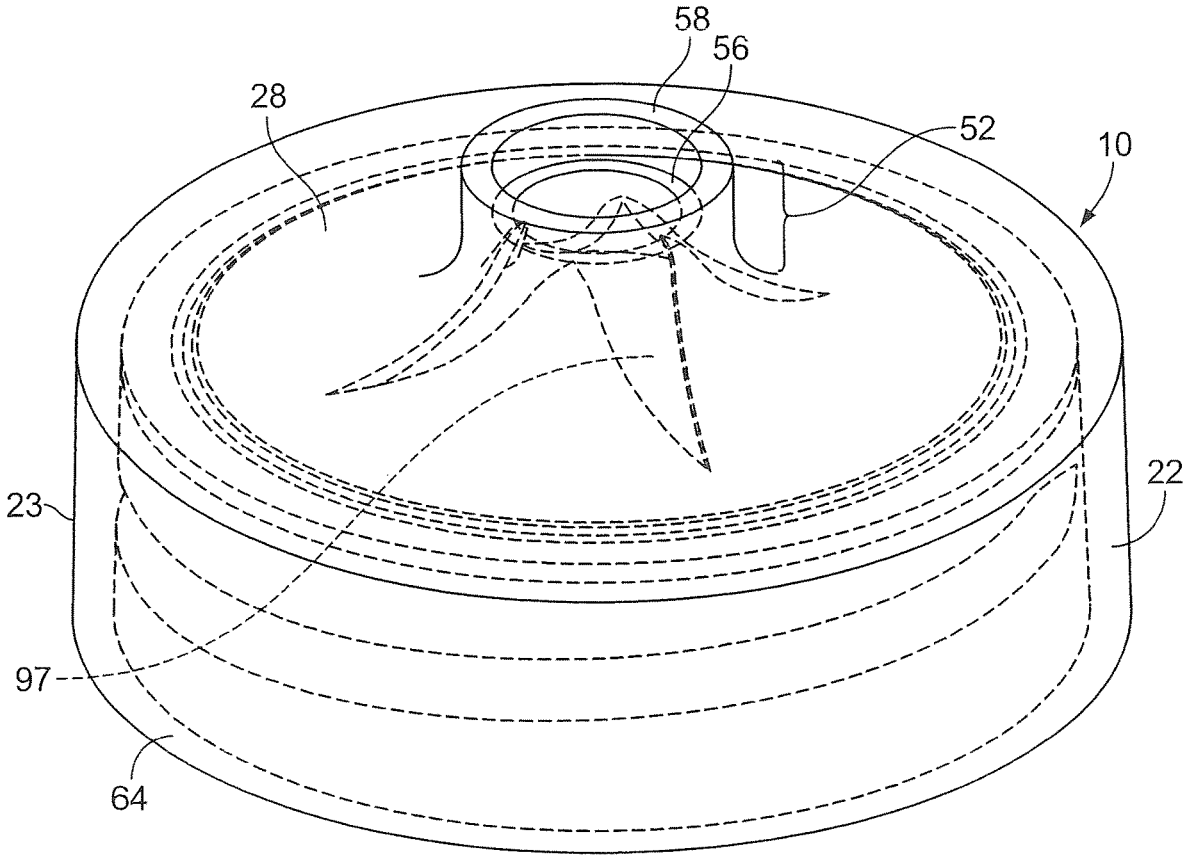
FIG. 3 shows a top perspective view of an embodiment of a dispensing closure assembly.
Figure 4:
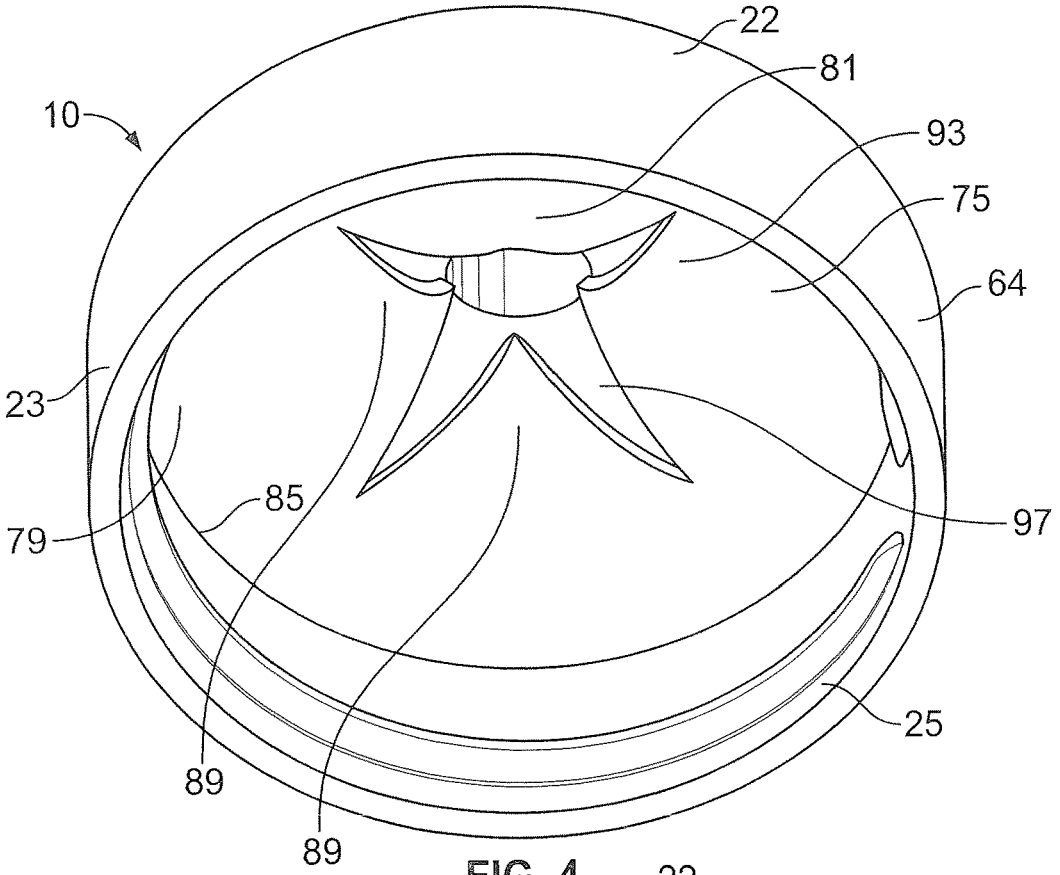
FIG. 4 shows a bottom perspective view of an embodiment of a dispensing closure assembly in an open configuration.

When the dispensing closure system 10 engages the container 112, the closure system 10 can adopt a closed configuration (see FIGS. 5-7) or an open (or dispensing configuration) (see FIGS. 2-4). Where the container 112 is a deformable container, the closure system 10 can adopt an undeformed or resting position, or an actuated position. The application or removal of positive pressure to the container 112 can cause the closure system 10 to change configurations or positions.

The liner 75 can be manufactured in an undeformed configuration, or can be arranged into an undeformed configuration when positioned within the closure system 10. In the absence of positive pressure applied to the container 112, the dispensing closure system 10 (and the liner 75) can adopt the resting or closed conformation. In some embodiments, the liner 75 can include a central portion 81 that defines essentially flat upper or lower surfaces 77, 79 that span or cover the mouth of the container 112 when the closure system 10 is in the closed configuration.

Before the dispensing closure system 10 is converted to the open or actuated conformation, the liner 75 can provide a barrier that can prevent flowable material in the container 112 from exiting the container 112. In some embodiments, when in dispensing closure system 10 is in the closed configuration, the liner 75 can provide an air tight and/or water tight seal; in other embodiments, the liner 75 is secured sufficiently to restrict the flowable material to the container 112, but without providing an air tight or water tight seal.

When a user squeezes or compresses the container 112, or otherwise causes an increase in the internal pressure inside the container 112, the pressure results in the free edges of the slits 87 separating from each other, thereby creating at least one opening 97 adjacent to the slits 87 through which a flowable material can exit (or enter) the container 112, as shown in FIGS. 3-4 and 11. In some embodiments, the separating slits 87 define flaps 89 or segments that lie adjacent to each other and define a substantially flat upper or lower surface 77, 79 (FIGS. 5-7, 10) when in a closed or unactuated configuration, and when in a dispensing configuration, the same flaps 89 or segments separate from each other and extend toward the orifice 58 of the closure 22, thus creating an opening 97 for dispensing flowable material. In some embodiments, the flaps 89 can retain some attachment to neighboring or adjacent flaps 89 and separate in such a manner as to create a plurality of openings 97 in the liner 75. In some embodiments, the flaps 89 can detach from neighboring or adjacent flaps 89 so as to create a larger opening 97 in the liner 75.

When in the actuated position, the flaps 89 can extend upward or outward until their edges or upper surfaces are configured against the interior surface 32 of the top wall 28. In some embodiments with a top wall 28 that slopes or arcs, the flaps 89 can separate and contact the sloping or arcing portion of the top wall 28; in these configurations, the top wall 28 can direct the flowable material away from the container 112, particularly when the closure assembly is inverted. When the dispensing closure system 10 converts from the closed configuration to the open or actuated position, the flaps 89 of the liner 75 can spread out until they contact a solid surface; here, the interior surface 32 of the top wall 28. The arcing or sloping nature of the collar 48 can guide the deforming liner 75 to adopt the most open configuration allowed by the structure of the closing system 10. Thus, the angled or sloping feature can increase the rate and volume of the flowable material out of the container 112.

FIG. 10 shows a top wall 28 that spans between the dispensing portion 52 and the skirt 64 of the closure 22, where the top wall 28 can have a profile that is flat or planar and is substantially perpendicular to both the dispensing portion 52 and the skirt 64. FIG. 8 shows versions of the top wall 28 that angles upward and inward from its junction with the skirt 64 toward the dispensing portion 52. FIG. 9 shows versions of the top wall 28 that smoothly curves upward and inward from its junction with the skirt 64 toward the dispensing portion 52. In profile, the top wall 28 have an exterior surface 30 having a concave shape. In FIGS. 8-9, the top wall 28 can join a dispensing portion 52 that extends upward and outward from the top wall 28.

As shown in FIGS. 16A-16D, a closure 22 can include a dispensing portion 52 especially configured for easy dispensing of flowable materials through the closure system 10. FIGS. 16A-16D show a contoured version of the top wall 28 that has an exterior surface 30 having a convex shape that contains an orifice 54 for dispensing materials into and out of the closure system 22. The top wall 28 can include, on its outer edge, an outer portion 31 that contacts the skirt 64. The outer edge can encircle or surround a central portion 33 of the top wall 28. Preferably, the outer portion 31 can define a flat surface that is substantially perpendicular to the skirt 64.

The central portion 33 can bulge upward and outward from the outer portion 31 and adopt a rounded or dome-like contour or shape. The central portion 33 can possess an elevation that is higher than the elevation of the outer portion 31 (when the closure system sits or rests atop a flat surface). It is preferred that the central portion 33 have an exterior surface that is smooth and rounded and convex.

In some embodiments, the central portion 33 can adopt the shape of a hemisphere or dome. In some embodiments, the central portion 33 can have a rounded shape that gives it a teardrop-shaped profile (e.g., FIG. 16B).

Located within the central portion 33, there can be an orifice 54 for dispensing materials through the closure system 10. The orifice 54 can be located in the center of the top wall 28, or can be offset from the center of the top wall 28. It is preferred that the orifice 54 be located in the central portion 33, rather than the outer portion 31 of the top wall 28. The orifice 54 can be centered over the liner 75 (e.g., FIG. 2) or the orifice 54 can be located in a non-central location.

The orifice 54 can include no more than a hole or perforation in the central portion 33, without rim or projection, thus preserving a smooth, rounded surface that lacks any concave structures or shape. Such a configured surface can provide a closure system 10 with an exterior surface that discourages the accumulation of flowable particles as they are dispensed from the closure system. In turn, this feature can provide a closure that requires less time and effort to clean.

In preferred embodiments, the flaps 89 can extend past the internal opening 56 of the dispensing portion 52, but do not extend past the external opening 58 of the orifice 54.

In some embodiments, upon cessation of squeezing or other reduction in the internal pressure, the liner 75 can return to its original undeformed position or shape. In preferred embodiments, upon a return to the undeformed position or shape, the liner 75 can adopt or resume a conformation that creates a seal, a seal that can be watertight or airtight, when the liner 75 is in the resting, undeformed configuration. In such closure systems, the liner 75 can thus provide a system capable of forming a resealable closure to the associated container 112.

In some embodiments, the dispensing portion 52 can have an internal opening 56 having a larger diameter than the external opening 58. Thus, when the closure system 10 is in the actuated position, the closure 22 can possess a general funnel shape for guiding flowable material to the external opening 58 and facilitating the efficient dispensing of the flowable material from the container 112. This funnel like conformation can be accentuated by sloping or arcing top walls 28, further increasing the flow rate and/or volume of the flowable material as it is dispensed through the closure assembly.

It will be understood that the foregoing description is of preferred exemplary embodiments of the invention and that the invention is not limited to the specific forms shown or described herein. Various modifications can be made in the design, arrangement, and type of elements disclosed herein, as well as the steps of making and using the invention without departing from the scope of the invention as expressed in the appended claims.

What is claimed is:

1. A closure system for an associated container that dispenses flowable product through a container opening by an application of manual pressure, comprising:

a closure having:

a dispensing portion;

an annular wall disposed radially around the dispensing portion, the annular wall sloping horizontally and vertically away from the dispensing portion to form a curving inner surface;

a skirt disposed radially around the annular wall; and a resiliently deformable liner having two or more slits defining a plurality of angular flaps, the resiliently deformable liner positioned between the closure and the container;

a movement of the angular flaps upward being restricted and limited by the curving inner surface:

the resiliently deformable liner sealing the flowable product within the container wherein upon the application of manual pressure to the container, the resiliently deformable finer deforms from an undeformed position to an actuated position, creating an opening adjacent to the flaps for allowing the flowable product to be dispensed from the container; and upon removal of manual pressure, the resiliently deformable liner returns to the undeformed position;

a peripheral wall radially disposed between the annular wall and the skirt, the peripheral wall being substantially perpendicular to the skirt; and, wherein the liner comprises an etched region surrounding the slits.

2. The closure system of claim 1, wherein the closure has an annular ring on an interior surface of the peripheral wall, for engaging the resiliently deformable liner between the closure and the container.

3. The closure system of claim 1, further comprising a cap engaging the closure.

4. The closure system of claim 1, wherein when in the actuated position, the flaps do not extend past a mouth of the dispensing portion.

5. The closure system of claim 1, wherein upon the return of the resiliently deformable liner to the undeformed position, the closure system provides a sealing system for the container.

6. The closure system of claim 1, wherein the annular wall is contoured to describe a radial arc.

* * * * *